United States Patent [19]

Mair et al.

[11] Patent Number: 4,686,862

[45] Date of Patent: Aug. 18, 1987

[54] LOW PROFILE PUMP JACK

[75] Inventors: Steven M. Mair, Watauga; Clyde S. Durham, Keller, both of Tex.

[73] Assignee: Mark IV Industries, Inc., Forth Worth, Tex.

[21] Appl. No.: 513,421

[22] Filed: Jul. 13, 1983

Related U.S. Application Data

[63] Continuation-in-part of Ser. No. 442,426, Nov. 17, 1982, abandoned.

[51] Int. Cl.[4] ..... F04B 47/02

[52] U.S. Cl. ..... 74/44; 74/41; 74/108

[58] Field of Search ..... 74/41, 590, 591, 25, 74/44, 108, 579, 581

[56] References Cited

U.S. PATENT DOCUMENTS

| | | | |
|---|---|---|---|
| 1,979,675 | 11/1934 | Croom | 74/591 |
| 2,123,679 | 7/1938 | Mahan | 74/591 |
| 2,152,701 | 4/1939 | Mansfield | 74/591 |
| 2,245,117 | 6/1941 | Shimer | 74/591 |
| 2,428,142 | 9/1947 | Carter | 74/591 |
| 2,441,255 | 5/1948 | Ashton | 74/591 |
| 2,618,172 | 11/1952 | Shoup | 74/591 |
| 3,027,221 | 4/1962 | Winfrey | 74/37 |
| 3,159,107 | 12/1964 | Hallmark | 103/212 |
| 3,310,988 | 3/1967 | Gault | 74/41 |
| 4,631,970 | 12/1986 | Pauls | 74/41 |

OTHER PUBLICATIONS

Greeno Industries Inc.-drawing of a pump, admitted prior art.

*Primary Examiner*—Lawrence Staab

*Attorney, Agent, or Firm*—Dressler, Goldsmith, Shore, Sutker & Milnamow, Ltd.

[57] ABSTRACT

A pump jack for reciprocating a string of rods in a well is disclosed in which a drive shaft having an axis below the axis of a guide wheel supported above the wall has a crank arm mounted to each end of the drive shaft for rotation therewith, counterweight means having a center of gravity offset from the axis of the drive shaft are mounted to each crank arm to assist in lifting the rods, and the inner ends of pitman arms are rotatably secured to the crank arms at a pivot point offset from the axis of the drive shaft. A cross bar is secured to the outer ends of the pitman arms and a flexible linkage extends over the guide wheel, this linkage having one end carried by the cross bar and the other end adapted to be secued to the string of rods, and the crank arm is constructed so that a radial from the drive shaft passing through the pivot point of the pitman arms will be substantially tangent to the top of the guide wheel when the counterweight means is at its uppermost position. All of this structure is mounted on a single skid with the drive shaft and its support being centrally located along the length of the skid, and with the drive means for the drive shaft being mounted on the end of the skid remote from the guide wheel. Various safety and repair expedients are described and preferred operation involves a wedge-shaped counterweight member and a precise angle between the connection to the pitman arm and the centerline of the counterweight member.

7 Claims, 2 Drawing Figures

LOW PROFILE PUMP JACK

Figure 1:
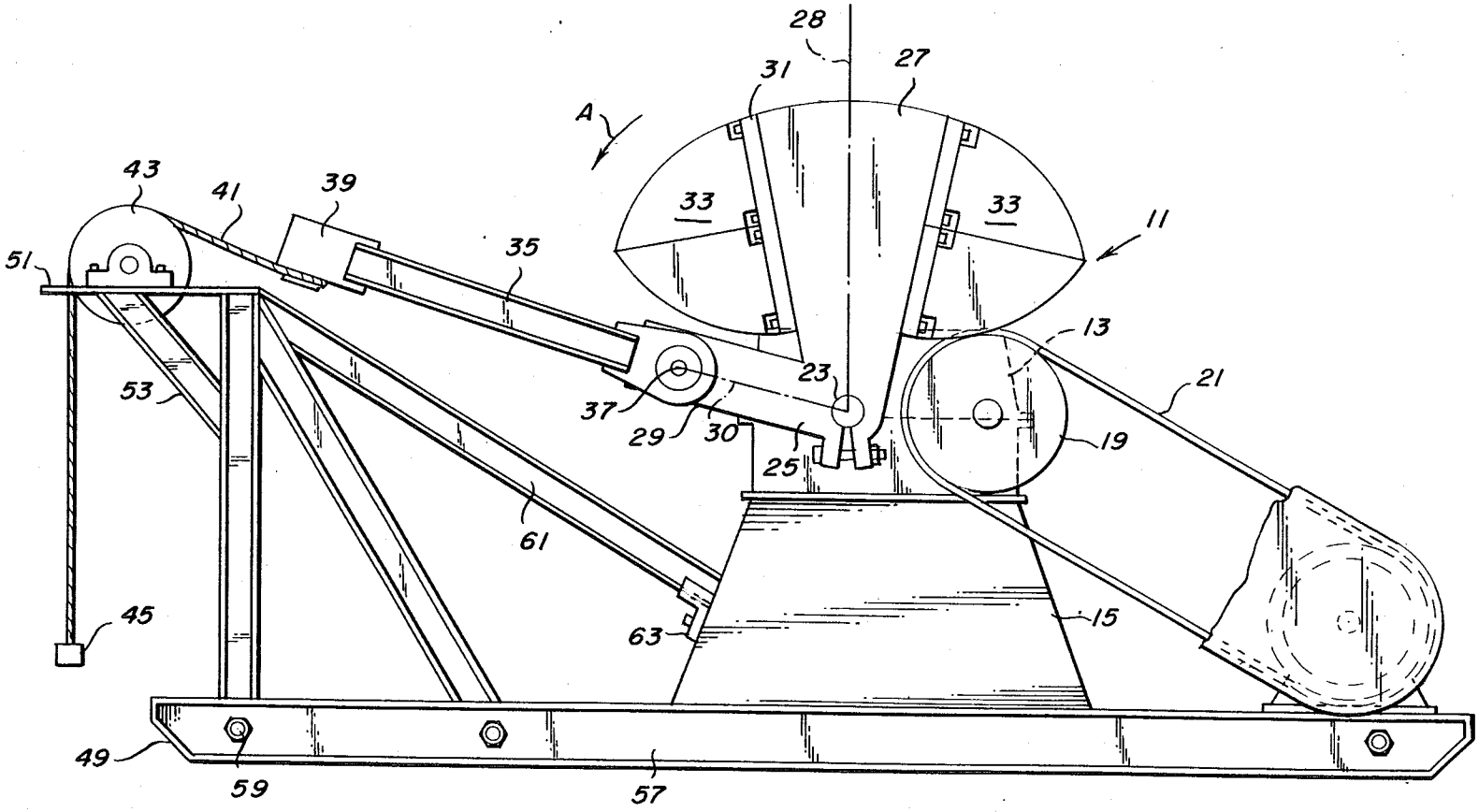

This application is a continuation-in-part of my prior application Ser. No. 442,426 filed 11/17/82 now abandoned.

DESCRIPTION

1. Technical Field

This invention relates to a surtace pump unit, known as a pump jack, for reciprocating a string of rods in a well, and in particular to a pump jack having a low height above the ground.

2. Background Art

Surface pump units, known in the industry as pump jacks, are commonly used for pumping oil wells. The typical surface pump jack has a walking beam that pivots on a post with what is called a horses head at one end of the beam. This end of the beam is connected to a string of rods for reciprocating the rods in the well. Counterweights are located at the other end of the walking beam for counterbalancing the weight of the rods. On the upstroke, the counterweights fall to help lift the rods. On the downstroke, the weight of the rods helps to lift the counterweight.

In general, deeper wells need larger pump jacks, both for lifting the weight of the rods and also to provide a longer stroke. These large pumps rise higher above the ground, and this prevents certain types of overhead irrigation equipment from being used for farming around the well site. One common type of irrigation system utilizes a long horizontal pipe located a distance above the ground. This pipe is mounted on wheels and is rotated in a circle about a pivot point. Many pump jacks have a height greater than the horizontal irrigating pipe, thus preventing this type of irrigating system from being used effectively because it cannot get past the pump jack.

Low profile pump jacks have been proposed to allow use of these types of overhead irrigation systems. Some of the proposals substitute cable and pulleys for the walking beams and horses head. While certain of these proposals are broadly workable, a low profile pump jack that efficiently uses the counterweights and is not subjected to excessive torque on the crank arm has not previously been provided, and is desirable for many reasons. Accordingly, and while pump jacks bearing some superficial resemblance to that of this invention have been tried, they have not been successful in the oil industry.

The pump jacks which employ a walking beam with a horses head overlying the well head are known as "walking horses" (because that is what they look like in operation) and are in common use. The pump jack of this invention has many advantages over this commonly used device. Thus, the pump jack of this invention on its skid can be shipped to the pump site assembled, and this is not practical for the "walking horse" units which are much larger and heavier. The pump jacks of this invention also consume less energy. As a rough measure of this economy in operation, corresponding pumping operations using an electric motor rated at 15 horsepower and 20 amps, it is found that the pumping operation draws only 6–8¾ amps, in contrast with the 13–17 amps normally required for the "walking horse" structures.

The lower profile unit of this invention not only allows overhead irrigation units to pass thereover, but the height reduction also considerably eases the burdens of maintenance and repair. One can gauge the greater ease and safety of working on a structure only 12–14 feet above the ground by contrasting that with the thought of working on one about 30 feet above the ground.

One must also understand that there is always a risk of a catastrophic accident, e.g., a downhole rod may part. With the "walking horse" construction, there is a danger of damage to the horse's head and also to the well head, and this danger is eliminated herein.

As a matter of interest, the need to lower the height of the conventional "walking horse" unit to permit irrigation units to pass overhead is so pressing that some of the walking horse units have been set into expensive below grade excavations. This introduces problems of drainage when it rains, stoppages when it snows, and other unforeseen problems also exist. Hydrogen sulfide gas normally blows away, but this gas is heavy and tends to accumulate in excavations. It is poisonous to man, and explosive in admixture with air. The problems are not simple and are avoided by the practical low profile unit provided by this invention.

DISCLOSURE OF INVENTION

In accordance with this invention, a pump jack is provided for reciprocating a string of rods in a well, this jack comprising, in combination: support means for rotatably supporting a guide wheel above the well; drive means for carrying and rotating a drive shaft, the drive shaft having an axis parallel with and lower than the axis of the guide wheel; a crank arm mounted to the drive shaft for rotation therewith; counterweight means mounted to the crank arm for assisting in lifting the rods, the counterweight means having a center of gravity offset from the axis of the drive shaft; a pitman arm having its inner end rotatably secured to the crank arm at a pivot point offset from the axis of the drive shaft; a flexible linkage extending over the guide wheel, having one end carried by the pitman arm and the other end secured to the string of rods; and the crank arm is constructed so that a radial line emanating from the drive shaft and passing through the pivot point of the pitman arm will be substantially tangent to the top of the guide wheel when the counterweight means is substantially at its uppermost position.

Pitman arms are normally provided at both sides of the drive shaft, the outer ends of the pitman arms being interconnected by a cross bar, and the end of the flexible linkage is secured to the cross bar to be carried by the pitman arms.

It is desired to point out that the geometry of the crank arm allows the pump jack of this invention to operate with a relatively constant load on the motor. Without this feature, the prior art structures failed in operation in one way or another. This geometry can be set forth in various ways, as will be discussed hereinafter.

As one feature of this invention, the support means for the guide wheel includes a vertical support element mounted on the supporting skid and an angled support interconnecting the axis of the guide wheel with the vertical support element at a point intermediate its length. This allows the guide wheel to overlie the well head while minimizing the tendency of the tension on the flexible linkage to tilt the supporting skid. Tilt resistance is further enhanced by having all of the parts of the jack mounted on a single skid with the drive shaft and its support being centrally located along the length of the skid and with the drive means being mounted on the end of the skid remote from the guide wheel. This places the massive elements of the jack far enough away from the guide wheel to counterbalance the tension on the linkage. The skid in this invention does not have to be bolted to the ground in a manner resisting tilting and lateral movement, and is normally simply rested in place on a gravel pad without being anchored.

Another feature is the introduction of an angled safety bar. If the flexible linkage breaks, the cross bar falls and can cause damage before conventional safety equipment can automatically stop the motor. While the motion stops, the cross bar rides on the safety bar to prevent destruction of the equipment.

It has also been found that the counterweight member performs more efficiently as the massive elements are moves away from the centerline as one moves away from the drive shaft. This has led to a bell or wedge-shaped counterweight member in which the counterweights are secured to a counterweight member which is narrower near the drive shaft and wider at the free end of the member. The angle between the edges of the counterweight member and its centerline is desirably from 10° to 25°, preferably about 20°.

Effective repair requires the guide wheel support to be pivotable away from the well head, and the vertical support is releasably connected to the skid and an angled brace holding the vertical support in place is pivotally connected to the skid so that the guide wheel and its support may be pivoted out of the way.

Lastly, it has been found that the angle between a radial interconnecting the axis of the drive shaft with the connection to the pitman arm to the counterweight member centerline is most advantageously in the range of 72° to 75°.

Figure 2:
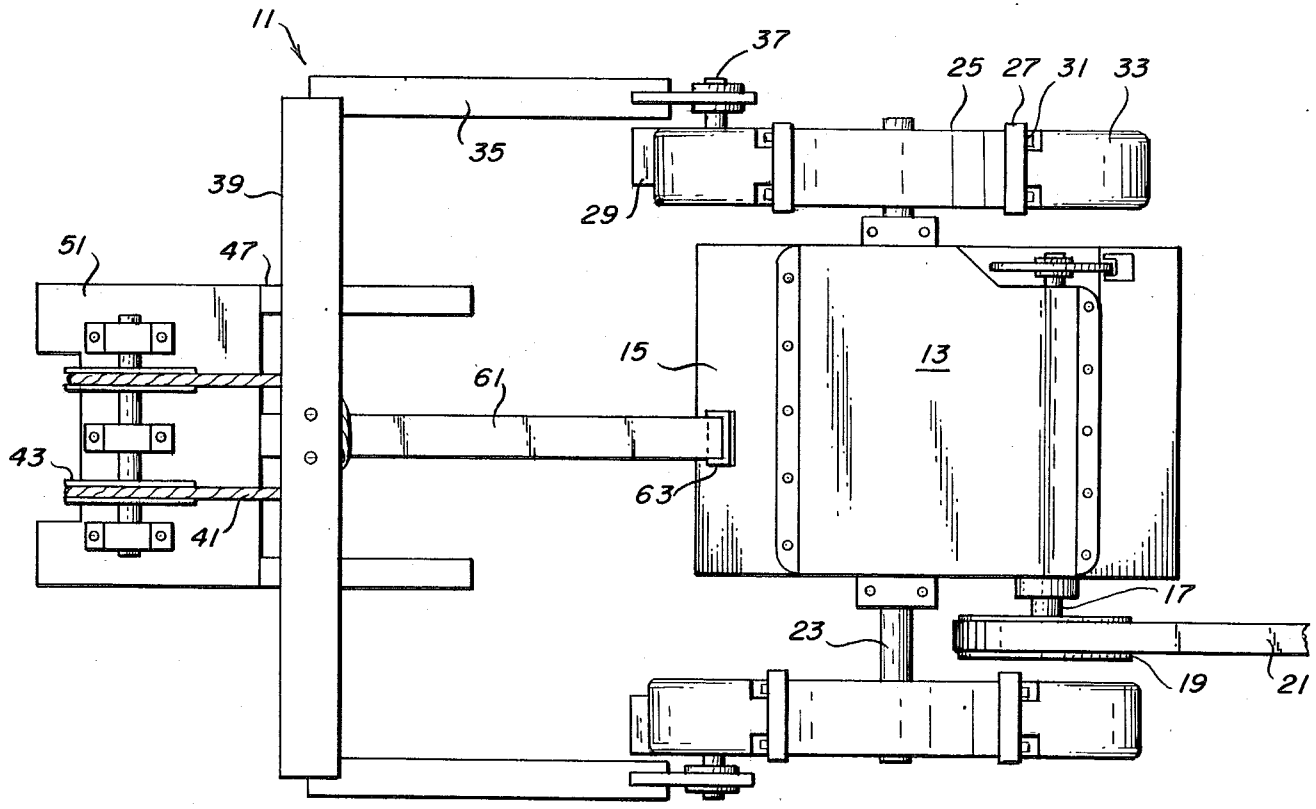

The invention will be more fully understood from the accompanying drawings in which:

FIG. 1 is a side elevation showing a portion of a pump jack constructed in accordance with this invention: and FIG. 2 is a top plan view of a portion of the pump jack shown in FIG. 1.

Referring to FIG. 1, pump jack 11 has a gear box 13 mounted on a platform 15. As shown in FIG. 2, gear box 13 has an input shaft 17 driven by pulley 19 via belt 21 which is connected to drive means 60, such as an electric motor. Platform 15 is in the center of skid 49 and the drive means 60 is at one end of the skid.

Gear Box 13 is used to reduce the speed of rotation delivered to an output or drive shaft 23. As seen in FIG. 1, drive shaft 23 has crank arm 25 rigidly connected to it for 360° rotation. The crank arm 25 has two members, a counterweight member 27 and a linkage member 29. Counterweight member 27 and linkage member 29 may be rectangular, but the member 27 is preferably wedge shaped, and these members are spaced apart from each other to provide a general "V" configuration with the base of the "V" being at drive shaft 23. The centerlines 28 and 30 of members 27 and 29 extend outwardly from the axis of drive shaft 23 of radial lines. The included angle between these radial lines must be acute, and is preferably in the range of from 65° to 75°.

Larger angles force the load on the motor to be nonuniform and this rapidly causes the apparatus to tear itself apart in one way or another, leading to rapid failure. In most preferred practice, the included angle is within the range of 72° to 75°.

Counterweight member 27 contains mounting means that includes mounting plates 31 for carrying the counterweights 33. These counterweights are located on both sides of member 27 and are of equal weight. The center of gravity of the combined counterweights is on a radial line from drive shaft 23 and on the centerline 28 of counterweight member 27. The weight of the counterweights 33 is the same as used with an ordinary walking beam, and it will depend upon the length of the string of rods being moved by the jack.

The linkage member 29 has a pitman arm 35 attached to it by means of a bearing or pivot point 37. Pivot point 37 allows the linkage member 29 to rotate 360° with respect to the pitman arm 35. Pitman arm 35 is a rectangular beam with a cross bar 39 connected to it. This cross bar (sometimes termed a cross beam) interconnects the pitman arm 35 shown in FIG. 1 with a like arm on the other side of the drive shaft 23. This is seen with greater clarity in FIG. 2 which shows that the drive shaft 23 carries an identical crank arm 25 on each end, each crank arm having counterweight members 27 with counterweights 33 and a pitman arm 35. The cross bar 39 connects the outer ends of the pitman arms 35 together. Cross bar 39 is parallel with the axis of drive shaft 23 and also with the axes of the pivot points 37. The length from the pivot points 37 to the cross bar 39 is greater than the length from the drive shaft 23 to the end of the counterweight member 27. This allows the counterweight member 27 and the counterweights 33 to swing between the pitman arms 35 and clear the cross bar 39 as the crank arm 25 rotates 360°.

As shown in FIG. 2, two cables 41 are secured to the cross bar 39. Each cable 41 is a flexible linkage that extends up over a guide wheel, sheave or pulley 43. The other end 45 of each cable 41 is adapted to be connected to a polished rod (not shown) which will be located in a sealing tube that is oriented vertically in conventional manner. A string of rods (not shown) is connected to the polished rod.

Guide wheel 43 is rotatably mounted on a support platform 51. The axis of guide wheel 43 is parallel with the axes of the pivot points 37 and drive shaft 23. The lower edge of guide wheel 43 is higher than the drive shaft 23. The upper edge of guide wheel 43 is lower than the end of counterweight member 27 when it is in its highest position, shown in FIG. 1.

Support platform 51 for guide wheel 43 rests on a vertical support element 47 which is releasably connected to skid 49 by bolt 59. An angled support 53 interconnects the guide wheel 43 (via platform 51) with vertical support 47 at a point intermediate its length. This allows the guide wheel 43 to overlie the well head while minimizing the tendency of the tension in the flexible linkage 41 to tilt the supporting skid 49. Diagonal brance 55 interconnects the top of vertical support 47 with skid 49 at a point intermediate the bottom of vertical support 47 and platform 15. This diagonal brace 55 is connected to skid 49 by pivot 57 so that, when bolt 59 is removed, the guide wheel 43 and its supporting structure may be pivoted away from the well head to facilitate its repair or maintenance.

An angled safety bar 61 is removably mounted by means not shown to the top of vertical support element 47 and by bracket 63 to the drive shaft platform 15. If the flexible linkage or one of the rods were to break, the cross bar 39 will fall onto the safety bar 61 where it will ride until the motor is stopped to prevent damage to the equipment. An automatic means is provided to stop the motor when excessive vibration is encountered, but this is itself conventional.

The height of support 47 and the configuration of crank arm 25 are selected to efficiently use the counterweights 33 and reduce bending moments or torques on crank arm 25. This is carried out by aligning the linkage member 29, pitman arms 35 and cables 41 in a generally straight line when the jack is at the bottom of its stroke, as pictured in FIG. 1. At the bottom of the stroke, the counterweight member 27 will be pointing vertically upward, or be slightly past vertical in its normal motion, thus placing the weights 33 in a position which puts the center of gravity in its highest position.

The centerline of the counterweight member 27 should be no more than 5° past a vertical line extending upward from drive shaft 23 when the cable end 45 is in its lowermost position. In this lowermost position, the center of gravity of the counterweights 33 will be substantially on a vertical line that extends upwardly from drive shaft 23 and a radial line from drive shaft 23 passing through pivot point 37 will be substantially tangent to the top of guide wheel 43.

At the top of the stroke, when cable end 45 is at its uppermost position, counterweight member 27 will be extending substantially vertically downward, or up to 5° past a vertical line extending dowward from the axis of drive shaft 23. In this position, linkage arm 29 will be 180° from the position shown in FIG. 1. A single radial line emanating from pivot point 37 will extend along linkage member 29, pass through the axis of drive shaft 23, and be substantially tangent to the top of guide wheel 43.

In operation, drive shaft 23 will be rotated normally counterclockwise when viewed from the position shown in FIG. 1 (see arrow A). As crank arm 25 rotates, its linkage member 29 pulls pitman arms 35 to the right for the upstroke of rods. Counterweights 33 fall during this upstroke to assist in lifting the rods. On the downstroke, the weight of the rods causes the pitman arms 35 to move outward or to the left. Counterweights 33 will be pulled up by the power supplied to drive shaft 23 by the weight of the rods. Pitman arms 35 will thus oscillate back and forth along with cables 41.

It should be apparent that the pump jack of this invention has many significant advantages, as has been discussed. It is to be particularly noted that the drive shaft 23 is removed from the end of the skid 49 by a distance of at least 55% of the length of the skid. The skid 49 thus resists tilting and need not be anchored in place adjacent the well head. This is particularly helpful because it minimizes site preparation, and it allows the skid with everything assembled thereon to be merely brought to the site and properly positioned with minimal preparation of the ground adjacent the well head. This is a significant economy.

While the invention has been illustrated in a preferred form, it should be apparent to those skilled in the art that the invention is not so-limited, but is susceptible to various changes without departing from this invention.

Also, it will be understood that while this invention has been described with reference to a counterclockwise rotation of the drive shaft 23, and while some of the parameters of the invention have been defined with reference to such counterclockwise rotation as a matter of convenience, in fact the apparatus can be operated with either a clockwise or counterclockwise rotation of shaft 23.

What is claimed is:

1. A pump jack for reciprocating a string of rods in a well, comprising in combination:

support means for rotatably supporting a guide wheel above the well;

drive means for carrying and rotating a drive shaft, said drive shaft having an axis parallel with and lower than the axis of the guide wheel;

a crank arm mounted to each end of the drive shaft for rotation therewith;

counterweight means mounted to each crank arm for assisting in lifting the rods, the counterweight means having a center of gravity offset from the axis of the drive shaft;

pitman arms, each pitman arm having its inner end rotatably secured to one of the crank arms at a pivot point offset from the axis of the drive shaft;

a cross bar secured to the outer ends of the pitman arms;

a flexible linkage extending over the guide wheel, said linkage having one end carried by the cross bar and the other end adapted to be secured to the string of rods; and the crank arm being constructed such that a radial line emanating from said drive shaft and passing through the pivot point of the pitman arms will be substantially tangent to the top of the guide wheel when the counterweight means is not more than 5° from its uppermost position, and the angle between a radial line interconnecting the axis of the drive shaft with the connection to the pitman arm to the counterweight member centerline is in the range of 72° to 75°;

all of the above being mounted on a single skid with said drive shaft being centrally located along the length of the skid remote from said guide wheel.

2. A pump jack as recited in claim 1 in which said support for the guide wheel includes a vertical support element mounted on the supporting skid, and an angled support interconnecting the axis of the guide wheel with the vertical support element at a point intermediate its length.

3. A pump jack as recited in claim 1 in which an angled safety bar is present to slidingly support said cross bar in the event that the flexible linkage breaks.

4. A pump jack as recited in claim 1 in which said counterweight means comprises a counterweight member extending away from said drive shaft as part of said crank arm, and counterweights carried by the sides of said counterweight member, said counterweight member being wedge-shaped to be narrower near the drive shaft.

5. A pump jack as recited in claim 4 in which the sides of said counterweight member are at an angle of from 10° to 25° to the centerline of the counterweight member.

6. A pump jack as recited in claim 2 in which the vertical support for said guide wheel is releasably connected to said skid, and an angled brace holds said vertical support in place, said brace being pivotally connected to said skid so that the guide wheel and its supporting structure may be pivoted out of the way.

7. A pump jack as recited in claim 1 in which said flexible linkage is connected to said string of rods, and said skid is unanchored.

* * * * *